US005340227A

United States Patent [19]

D'Andrade

[11] Patent Number: 5,340,227

[45] Date of Patent: Aug. 23, 1994

[54] WATER PROJECTING PUMP ACTION PEN

[76] Inventor: Bruce M. D'Andrade, 3 Ten Eyck Rd., Whitehouse Station, N.J. 08889

[21] Appl. No.: 97,275

[22] Filed: Jul. 26, 1993

[51] Int. Cl.[5] ..... B43K 29/00

[52] U.S. Cl. ..... 401/195; 446/180; 446/475

[58] Field of Search ..... 401/195, 52; 446/71, 446/76, 180, 475

[56] References Cited

U.S. PATENT DOCUMENTS

| | | | |
|---|---|---|---|
| 1,153,206 | 9/1915 | Eisenberg | 446/180 |
| 2,354,402 | 7/1944 | Petruccione et al. . | |
| 3,282,253 | 11/1966 | Ryan et al. | 401/195 X |
| 3,432,077 | 3/1969 | Voll . | |
| 3,635,374 | 1/1972 | Anketell . | |
| 3,756,467 | 9/1973 | Anketell . | |
| 3,830,404 | 8/1974 | Frazer . | |
| 4,193,517 | 3/1980 | Fetty et al. . | |
| 4,244,525 | 1/1981 | Manna | 401/195 X |
| 4,550,861 | 12/1985 | Fay, Sr. et al. . | |
| 4,703,892 | 12/1987 | Nadel . | |
| 4,733,799 | 3/1988 | Wiskur . | |
| 5,174,477 | 12/1992 | Schafer . | |

FOREIGN PATENT DOCUMENTS

| | | | |
|---|---|---|---|
| 1488448 | 6/1967 | France | 401/195 |
| 2252941 | 8/1992 | United Kingdom | 401/195 |

*Primary Examiner*—Danton D. DeMille
*Attorney, Agent, or Firm*—Kenneth P. Glynn

[57] ABSTRACT

The present invention is a toy pen having liquid projecting pump action capabilities. It includes a main housing and an upper section which, together, simulate a pen. The main housing and upper section include a liquid storage reservoir and a cylinder and piston. The piston and upper section are connected to one another so that reciprocation of the upper section causes the piston to reciprocate and pump liquid from the storage reservoir to the cylinder and from the cylinder to a nozzle for projection therefrom. Preferably, two one way valves are included, one to permit flow from the reservoir to the cylinder, but not vice versa, and the other to permit flow from the cylinder to the nozzle, but not vice versa. In preferred embodiments, there is an air vent which is closed when the piston is up, i.e. the cylinder is open, and which is open when the piston is not fully up.

10 Claims, 2 Drawing Sheets

WATER PROJECTING PUMP ACTION PEN

BACKGROUND OF THE INVENTION

Field of the Invention

The present invention relates to toy liquid projecting pens. More particularly, it relates to water projecting pump action pens which are capable of repeat shootings without the need to refill a main water storage reservoir. In preferred embodiments, the toy pen will also function as a normal pen and is capable of use for writing.

Information Disclosure Statement

The use of pens and other cylindrical objects for projecting liquids is known. There is a trick pen used in early comedy movies which ejects a spray of ink from its writing end when the fill lever is pulled. Other prior art of interest is as follows:

U.S. Pat. No. 2,354,402 issued to M. J. Petruccione et al sets forth a combined pencil and first aid kit wherein antiseptic solutions and band aids, etc., are stored in the main body.

U.S. Pat. No. 3,432,077 to Samuel Voll describes a night stick having a pressurized spray device placed therein. A cap end is spring loaded and may be depressed to activate an aerosol cylinder for spraying a tear gas, dye or the like. Likewise, U.S. Pat. No. 3,635,374 to John Anketell describes a fluid-dispensing club for releasing a pressurized fluid such as a tear gas. It utilizes a trigger mechanism for activation. Further, U.S. Pat. No. 3,756,467, also to John Anketell, also describes a night stick with a pressurized cartridge and release mechanism.

U.S. Pat. No. 3,830,404 issued to John Frazer sets forth a simulated writing instrument aerosol container. The top of the pen is depressed to cause a pressurized container, formed as the lower portion of the pen, to release a spray of medicine or other liquid.

U.S. Pat. No. 4,193,517 issued to Warren Fetty et al describes a water squirt cane having a mobile figure as an activator. It uses a reciprocating plunger hand pump to shoot water stored in the cane.

U.S. Pat. No. 4,550,861 to James Fay et al sets forth a simulated wrist watch which includes a release valve for releasing a dye and lachrymator which is pressurized with nitrogen.

U.S. Pat. No. 4,703,892 to Melvin Nadel illustrates a water shooting amusement device which utilizes a squeeze bottle type arrangement for shooting the water, e.g. out the mouth of a simulated snake.

U.S. Pat. No. 4,733,799 describes a water cannon toy wherein two cylindrical portions are slidable relative to one another, with one acting as a piston and the other as a cylinder.

U.S. Pat. No. 5,174,477 describes a water squirt toy which uses a length of elastic tubing with a nozzle and a clip clamp. A nozzle is included and this may be any type of squeeze nozzle including small tubular inserts or the bottom portion of a ball point pen barrel.

Notwithstanding the aforesaid prior art, the present invention toy water projecting multi-shot pump action air vented pen is neither taught nor rendered obvious.

SUMMARY OF THE INVENTION

The present invention is a toy pen having liquid projecting pump action capabilities. It includes a main housing and an upper section which, together, simulate a pen. The main housing and upper section include a liquid storage reservoir and a cylinder and piston. The piston and upper section are connected to one another so that reciprocation of the upper section causes the piston to reciprocate and pump liquid from the storage reservoir to the cylinder and from the cylinder to a nozzle for projection therefrom. Preferably, two one way valves are included, one to permit flow from the reservoir to the cylinder, but not vice versa, and the other to permit flow from the cylinder to the nozzle, but not vice versa. In preferred embodiments, there is an air vent which is closed when the piston is up, i.e. the cylinder is open, and which is open when the piston is not fully up.

BRIEF DESCRIPTION OF THE DRAWINGS

The present invention is more fully understood when the specification herein is taken in conjunction with the drawings appended hereto.

BRIEF DESCRIPTION OF THE PRESENT INVENTION

The present invention toy pen is a toy because it may be used for fun and amusement, i.e. to shoot water at someone by surprise. The term "pen" should be taken broadly to mean a writing instrument and includes, but is not limited to ball point pens, ink well pens, cartridge pens, lead pens (mechanical pencils), writing markers and make-up pencils. Thus, the pen of the present invention has as its external characteristics the basic features of a writing instrument, herein referred to as a "pen".

Figure 1:
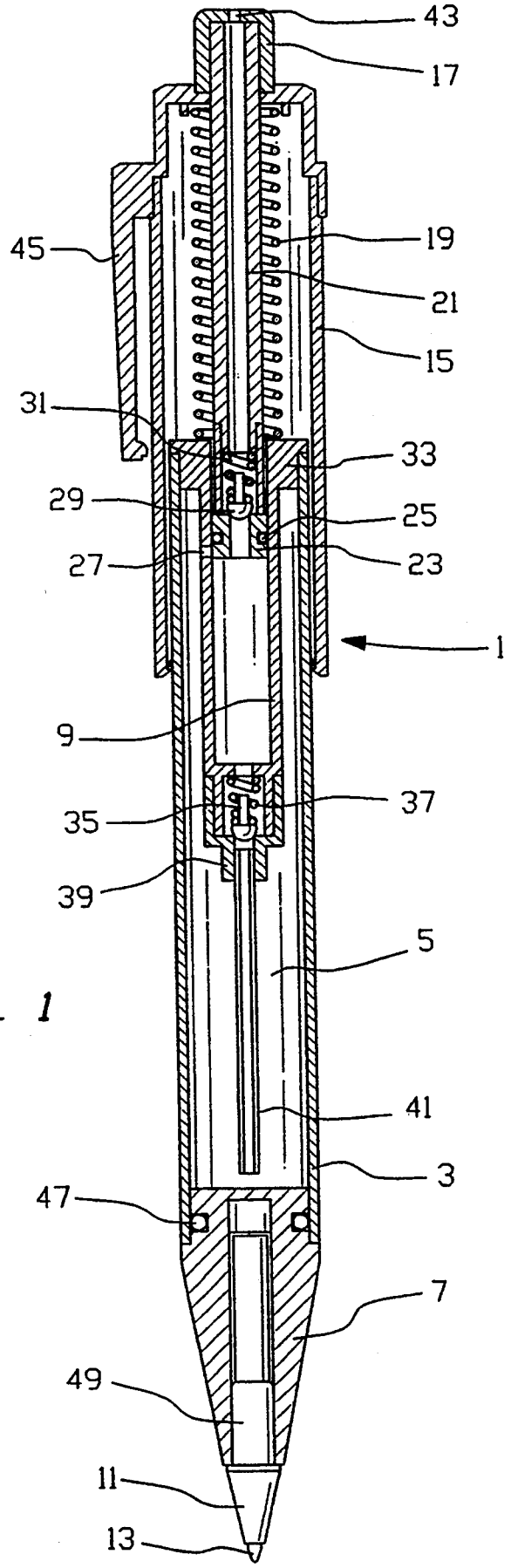
FIG. 1 shows a side cut view of a preferred water projecting pump action pen of the present invention; and, FIG. 2 shows a blown-up partial view of the FIG. 1 pen.

FIG. 1 shows a side cut view of a present invention pen 1. This includes a hollow main housing 3 and a water storage reservoir 5 therein. In this case, reservoir 5 is actually formed by the main housing 3 itself, but could alternatively be formed of a separate vessel contained therein.

Refill cap 7 is located at the open bottom of main housing 3 and is removable but securely attached, e.g. force fitted, threaded, or snapped in. It includes O-ring seal 47 to prevent leakage. Refill cap 7 has optional cartridge holder 49 with tapered pen tips 11 and writing tip 13, which may be ink or graplute or otherwise. These aspects may include real or actual writing capability, as discussed, or may, alternatively, be a simulation thereof.

Within reservoir 5 is cylinder 9. This is located within main housing 3 at reservoir 5 but could, alternatively, be located in upper section 15, or in both upper section 15 and main housing 3, as long as it connects with reservoir 5. Here, the cylinder 9 has inlet 39 with one way valve 35 and spring 37, with pick up tube 41 extending down into reservoir 5. One way valve 35 permits water to flow from liquid storage reservoir 5 to cylinder 9, but not the reverse. Spring 37 maintains the valve 35 in the closed position. When piston 23 is reciprocated, when it is in its upstroke, valve 35 will be pulled up against spring 37 to open and permit flow to cylinder 9.

At the top of cylinder 9 is a support ring 33 which holds cylinder 9 in place and which forms the top of reservoir 5 and seals reservoir 5, except at vent part 11, discussed below with respect to FIG. 2. Also located at the top of cylinder 9 is piston 23 with O-ring seal 25, one way valve 29 with spring 31, and combination outlet tube/push rod 21. One way valve 29 is maintained closed via spring 31, except that when piston 23 is pushed downward (down stroke) the liquid in cylinder 9 (or air on the first, priming stroke) pushes valve 29 open and the liquid is permitted to flow from cylinder 9 to outlet tube/push rod 21, but not vice versa. The liquid exits through nozzle 43 in pen top 17.

Outlet tube/push rod 21 is connected to piston 23 at its bottom, both mechanically and for fluid flow. At the top of outlet tube/push 21, it is connected to upper section 15. This upper section 15, with clip 45, is movable axially with respect to main housing 3 and is biased upwardly via large spring 19. Thus, as upper section 15 is reciprocated from a first, upward position, down to its second, lowest position, and then returned to its first position, piston 23 concomitantly moves from its open cylinder (upward) position, as shown, down cylinder 9 to its closed cylinder position and back to the open cylinder position. In its down stroke, piston 23 pushes liquid from reservoir 5 to cylinder 9 and thus reloads cylinder 9 for the next shot.

Figure 2:
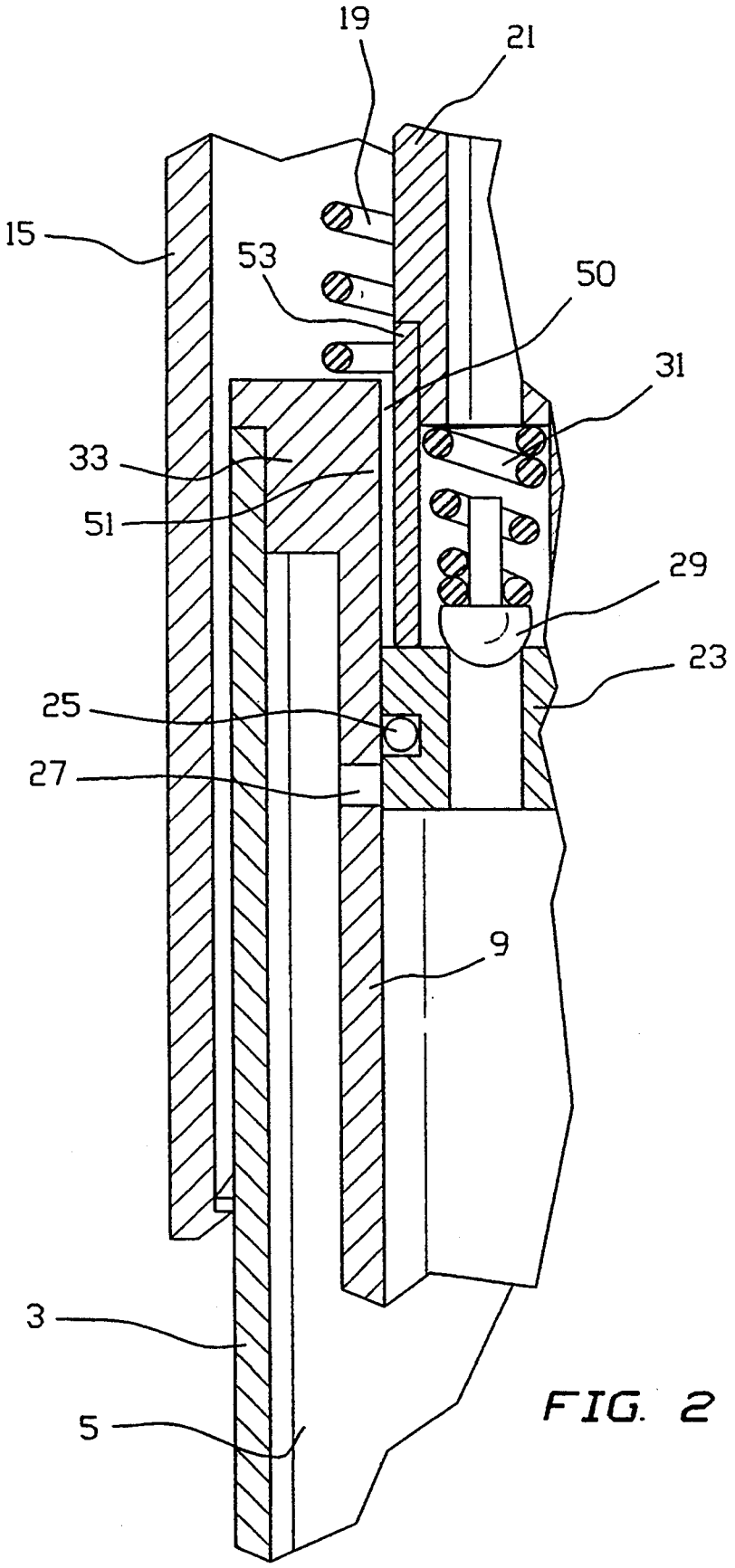

FIG. 2 shows a partial cut view of FIG. 1 pen 1, emphasizing the area about vent port 27. Note that all identical aspects are identically numbered to those shown in FIG. 1.

Referring to both FIGS. 1 and 2 and visualizing the reciprocation of piston 23, just discussed, it can be seen that piston 23 blocks vent port 27 when it is in its first (open cylinder) position shown. However, when piston 23 is moved away from vent port 27, i.e. moved downwardly, the air space 50 between inside wall 51 of support ring 33 and valve housing wall 53, shown in FIG. 2, will move down next to vent port 27 and allow air to enter reservoir 5 to reduce suction forces which would require force to overcome for pumping. Uniquely, venting to reservoir 5 only occurs when piston 23 is not in its rest position, and when it is in its rest position it seals vent port 27, preventing undesirable leakage which might occur in conventional vent arrangements. This multiple use of the piston to act as a vent valve is a preferred embodiment of the present invention, although less desirable conventional vent holes could be used, but at the risk of some leakage.

Obviously, numerous modifications and variations of the present invention are possible in light of the above teachings. It is therefore understood that within the scope of the appended claims, the invention may be practiced otherwise than as specifically described herein.

What is claimed is:

1. A toy pen capable of projecting a liquid such as water therefrom, which comprises:

(a) a hollow main housing having an open top and at least one sidewall and an open bottom, and having a general external appearance of a lower portion of a pen, said main housing having a liquid storage reservoir therein;

(b) a hollow upper section connected to the top of said main body and being axially movable relative thereto, said upper section having the general external appearance of an upper portion of a pen, said upper section having a nozzle therein;

(c) a cylinder, and a piston movably located within said cylinder, said cylinder being located within said pen and having an inlet connected to said liquid storage reservoir and an outlet connected to said nozzle, said piston being biased upwardly to a first, rest position which is an upward position, and being movable within said cylinder to a second, downward position, and thus having a downstroke followed by an upstroke, said piston being fixably connected to said upper section such that when said upper section is reciprocated manually relative to said main housing, said piston is similarly reciprocated within said cylinder and when liquid is contained within said liquid storage reservoir, reciprocation of said upper section will result in said piston pumping liquid from said liquid storage reservoir to said cylinder and also from said cylinder through said cylinder outlet so as to project liquid through said nozzle; and, (d) a vent port located on said cylinder and extending from said cylinder to said liquid storage reservoir and being located adjacent to said piston when said piston is positioned in its upward position such that said piston closes said vent, and further when said piston is not in its upward position, said vent port permits air to enter said liquid storage reservoir to reduce resistive suction forces otherwise being created therein when said piston is reciprocated.

2. The toy pen of claim 1 wherein said cylinder has a first one way valve located at its inlet so as to permit liquid to move from said liquid storage reservoir to said cylinder and not vice versa.

3. The toy pen of claim 1 wherein said piston has an outlet orifice therein and a second one way valve located between said piston and said nozzle so as to permit liquid to flow from said cylinder to said nozzle and not vice versa.

4. The toy pen of claim 2 wherein said piston has an outlet orifice therein and a second one way valve located between said piston and said nozzle so as to permit liquid to flow from said cylinder to said nozzle and not vice versa.

5. The toy pen of claim 1 wherein said upper section has a first position corresponding to an open cylinder position of said piston, and has a second position corresponding to a closed cylinder position of said piston.

6. The toy pen of claim 1 wherein said vent port is adapted to permit air intake to said liquid storage reservoir during said upstroke of said piston.

7. The toy pen of claim 1 wherein said main housing includes a refill cap at the bottom thereof removably connected thereto.

8. The toy pen of claim 7 further wherein said refill cap includes a cartridge with writing means extending therefrom.

9. The toy pen of claim 4 wherein said main housing includes a refill cap at the bottom thereof removably connected thereto.

10. The toy pen of claim 9 further wherein said refill cap includes a cartridge with writing means extending therefrom.

* * * * *